United States Patent [19]

Amann et al.

[11] 4,398,374

[45] Aug. 16, 1983

[54] POLISHING MACHINE HAVING A ROTARY RECIPROCATING SHAFT

[75] Inventors: Franz Amann, Regensburg; Peter Listl, Sinzing, both of Fed. Rep. of Germany

[73] Assignee: Maschinenfabrik Reinhausen Gebrüder Scheubeck GmbH & Co. KG, Regensburg, Fed. Rep. of Germany

[21] Appl. No.: 287,331

[22] Filed: Jul. 27, 1981

[30] Foreign Application Priority Data

Aug. 2, 1981 [DE] Fed. Rep. of Germany ..... 3029417

[51] Int. Cl.[3] ..... B24B 7/00; F16H 37/16

[52] U.S. Cl. ..... 51/31; 74/22 R; 51/34 K

[58] Field of Search ..... 51/31, 34 K, 56 R, 54; 74/22 R, 22 A, 60

[56] References Cited

U.S. PATENT DOCUMENTS

| | | | |
|---|---|---|---|
| 2,542,408 | 2/1951 | Gridley | 51/34 K |
| 2,578,559 | 12/1951 | Korsgren | 74/60 |
| 3,538,646 | 11/1970 | Beal | 51/34 K |
| 3,757,638 | 9/1973 | Martin | 74/842 |

FOREIGN PATENT DOCUMENTS

| | | | |
|---|---|---|---|
| 623715 | 6/1927 | France . | |
| 672469 | 6/1950 | United Kingdom . | |
| 220086 | 4/1959 | U.S.S.R. | 51/34 K |

*Primary Examiner*—Harold D. Whitehead
*Assistant Examiner*—Robert A. Rose
*Attorney, Agent, or Firm*—Karl F. Ross; Herbert Dubno

[57] ABSTRACT

The grinding and polishing machine has a tool-carrying spindle (1) driven with a combined rotating and rocking action. It has a driving shaft (4) which is reciprocated axially and passes through a disc (8) which slopes at an acute angle. Above this disc is a second disc attached to the shaft, with a roller (5) attached to its periphery which rotates against the sloping disc. The tool spindle also passes through another sloping disc and through a plate (12) with a peripheral roller (16) which travels against this second sloping disc.

The tool spindle carries an arm (13) with a dog projecting from it to fit into a hole in the plate to rotate the same. This plate also has a dog (14) which fits into a hole (15) in the disc attached to the driving shaft so that it transmits rotary movement for driving the tool spindle.

7 Claims, 4 Drawing Figures

POLISHING MACHINE HAVING A ROTARY RECIPROCATING SHAFT

BACKGROUND OF THE INVENTION

One of the major problems underlying the design of machines of the aforementioned type lies in the fact that the axial motions of the shaft which support the tool may be transmitted to other parts of the machine, including its housing or frame structure.

It is the principal object of the invention to avoid this serious drawback.

Another object of the invention is to provide means which localize the oscillation of the tool-supporting shaft in a direction longitudinally thereof, and do not allow propagation of these oscillations to parts of the machine where they are undesirable.

Other objects of the invention and advantages thereof will become more apparent as this specification proceeds.

SUMMARY OF THE INVENTION

The undesirable oscillations are caused by the linear movements of the mass of the tool-supporting shaft and the mass of parts forming a part of, or connected with, the tool-supporting shaft.

According to this invention a solid of revolution is interposed between the motor-driven shaft and the tool-supporting shaft. This motor-driven shaft transmits its rotary motion by positive means—e.g. a crank mechanism—to the solid of rotation. The solid of rotation transmits its rotary motion by positive means—e.g. a crank mechanism—to the tool-supporting shaft, or to a part integral with that shaft.

The solid of rotation and the tool-supporting shaft, or parts integral with said shaft, are caused to perform oscillations which are both in a direction longitudinally of the motor-driven shaft and the tool-supporting shaft, but whose phase relation differs generally by 180 deg. Thus when the solid of revolution is moving up, the tool-supporting shaft and the tool supported by it move down, and vice versa. The mass of the solid of rotation is more or less equal to the mass of the tool-supporting shaft, and the mass of the tool supported by it, and this provides a more or less complete compensation normally caused by the oscillation of the tool-supporting shaft and the tool supported by it in a direction longitudinally of the tool-supporting shaft.

The means for causing the out of phase oscillations of the solid of rotation and of the tool-supporting shaft are bearings which project in cantilever fashion from the solid of rotation and from the tool-supporting shaft, or parts integral with it, and which are under the control of control plates which act in cam-like fashion upon said bearings. These control plates have opposite inclinations relative to the axes of the motor-driven shaft and the tool-supporting shaft, which result in the aforementioned phase relation of the oscillations of the solid of rotation and the tool-supporting shaft.

Springs or the like maintain engagement of the rotating bearings and the control plates.

DESCRIPTION OF PRIOR ART MACHINE

Figure 1:
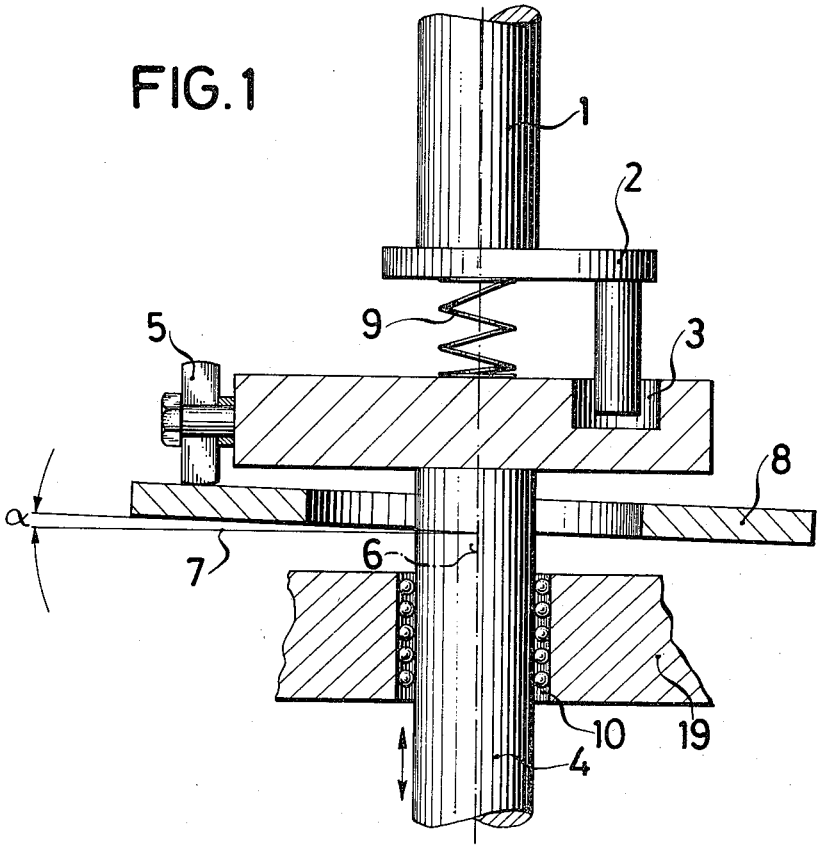
FIG. 1 is a diagrammatic elevational view of a prior art machine.

Referring now to FIG. 1 of the drawing, reference character 1 has been applied to indicate a driven shaft which may be driven by any suitable motor means. Shaft 1 is provided with an eccentric 2 closely engaging a recess 3 in a shaft 4. Shaft 4 supports at its lower end a rotating tool, such as, for instance, a polishing tool (not shown). Shaft 4 expands at its upper end to a plate forming an integral part of it. That plate is provided with a bearing 5 that projects from it in cantilever fashion. As soon as shaft 1 is driven, bearing 5 rotates with shaft 4. Bearing 5 is supported by a supporting plate 8 and firmly held in engagement with that plate by a spring 9 interposed between eccentric 2 and the upper part of shaft 4. The trajectory of bearing 5 is inclined in regard to plane 7 which is at right angles to vertical axis 6 of shaft 4. This angle of inclination has been designated by reference character $\alpha$. Hence, shaft 4 will be subjected to a composite motion, namely a rotary motion, and an up-and-down motion indicated by a line having arrowheads pointing in opposite direction. To allow this up-and-down motion shaft 4 is surrounded by a sleeve or slide bearing including a plurality of balls 10 of a housing 19 which has been indicated but diagrammatically in FIG. 1. Generally the inclination $\alpha$ of supporting plate 8 is variable, in order to be able to vary the amplitudes of shaft 4.

DESCRIPTION OF PREFERRED EMBODIMENTS OF THE INVENTION

Figure 2:
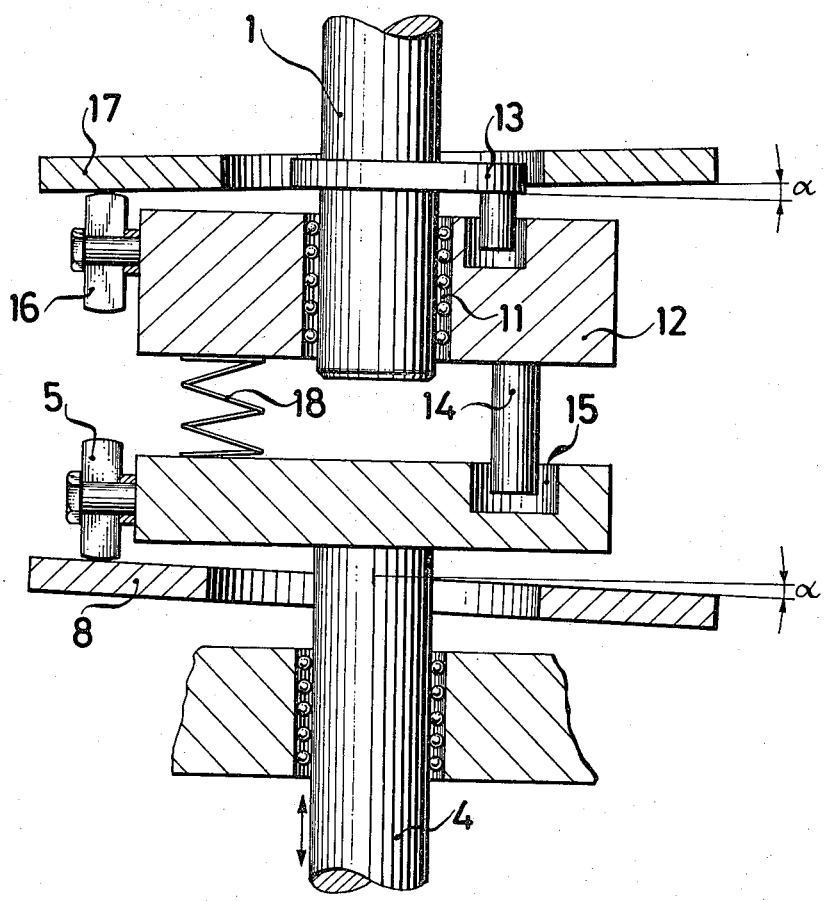
FIG. 2 is a corresponding view of a machine according to the present invention.

Referring now to FIG. 2, driven shaft 1 engages a solid of rotation 12 provided with a sleeve bearing 11 including balls. The solid of rotation 12 is intended as a means for compensating for the mass of shaft 4 and for that of a tool (not shown) supported on the lower end of shaft 4. The solid of rotation is tightly coupled by eccentric 13 with driven shaft 1. The solid of revolution 12 is provided with a pin 14 fitting tightly into recess 15 of the plate-shaped upper end of shaft 4. The upper end of shaft 4 is provided with a bearing 5 projecting in cantilever fashion from its upper plate-like portion of enlarged diameter. Bearing 5 is supported by plate 8 having an inclination designated by the reference character $\alpha$. This arrangement of parts results in an oscillatory longitudinal motion of shaft 4 which has been designated by an arrow having two opposed arrow heads. In a fashion similar to shaft 4, the solid of rotation 12 is provided with a bearing 16 projecting in cantilever-like fashion from it. This bearing 16 rotates jointly with shaft 1 and solid of rotation 12. In rotating it engages disk 17. Disk 17 is inclined as disk 8, but the inclination of disk 17 is opposite to that of disk 8. A compression spring 18 is interposed between the solid of rotation 12 and the plate-shaped head of shaft 4, maintaining bearings 5 and 16 in firm engagement with their respective supporting or control plates 8 and 17.

Figure 3:
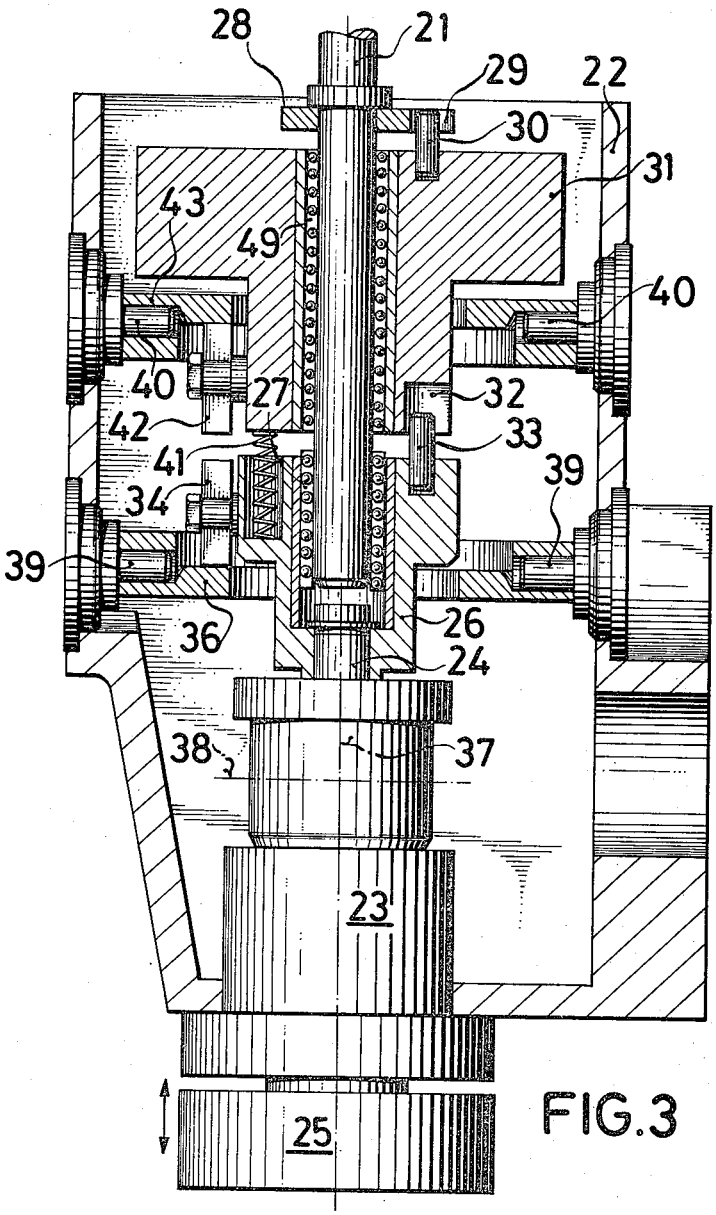
FIG. 3 is a vertical section of another machine according to the present invention restricted to the parts essential for its performance.
Figure 4:
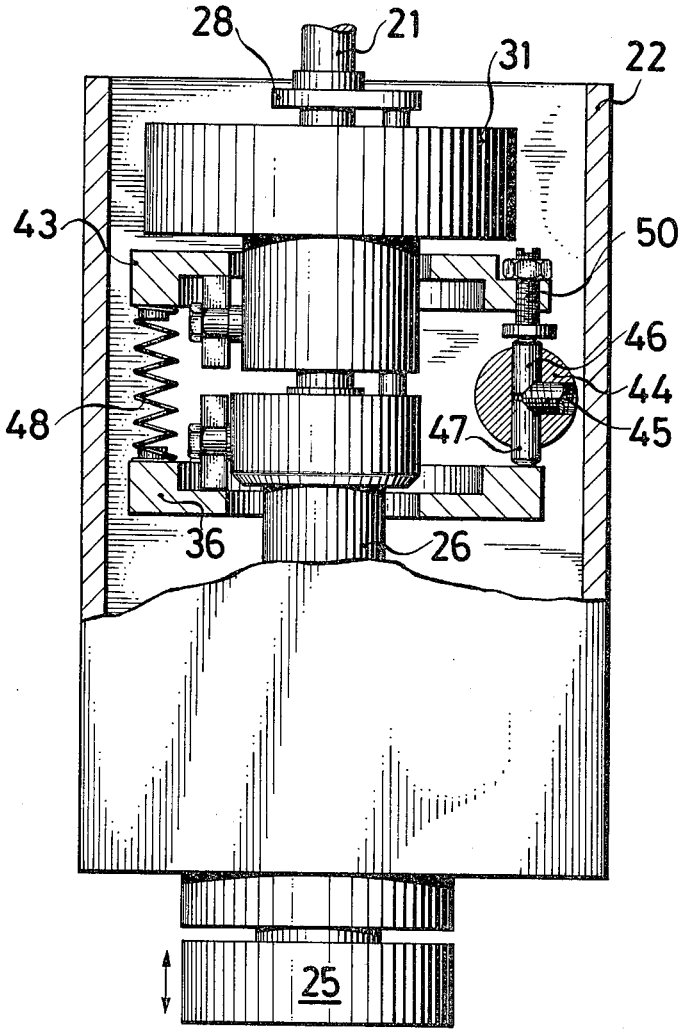
FIG. 4 is another vertical section through the machine shown in FIG. 3 taken along a plane at 90° to the plane of FIG. 3.

Referring now to FIGS. 3 and 4, reference numeral 21 has been applied to indicate a driven shaft. This shaft is supported in a way (not shown) in the housing head 22 of a polishing machine. Housing head 22 contains also bearing means 23 for supporting shaft 24. The lower end of shaft 24 supports the polishing tool 25 proper. Shaft 24 and shaft 21 are arranged in coaxial relation. Reference numeral 26 has been applied to indicate a sleeve-like structure supporting shaft 24. A bearing 27 comprising a plurality of balls is arranged inside of sleeve-like structure 26 to allow the oscillatory motion of shaft 24 to be described below in greater detail.

The driven shaft 21 and shaft 4 are coupled as stated below in detail. The eccentric 28 on shaft 21 engages recess 29 with its pin 30. Pin 30 is positively connected with the solid of revolution 31. The solid of revolution 31 is provided with a recess 32 engaged by pin 33. The latter is firmly connected to the sleeve-like structure 26 to which reference has been made above supporting shaft 24. When driven shaft 21 is rotated by any appropriate motor means, the rotary motion of shaft 21 is transmitted by parts 28, 30, 31, 33, and 26 to shaft 24.

The shaft 24 is supposed to oscillate in a direction longitudinally thereof. This requirement is met by the mechanism described below.

The part 26 is provided with a bearing 34 which projects in cantilever fashion from it. When part 26 rotates, the trajectory of bearing 34 is controlled by plate or disk 36 in engagement with bearing 34. The inclination of plate or disk 36 relative to a plane 38 at right angles to axis 37 is adjustable. To this end plate 36 is pivotally supported by pins 39. It will be apparent that by inclining disk 36 and applying pressure upon bearing 34 an oscillatory motion is imparted to shaft 24 in a direction longitudinally thereof. Compression spring 41 is the means providing that pressure.

The solid of rotation 31 is likewise provided with a bearing 42 which projects from it in cantilever-like fashion, as bearing 34 projects from part 26. If shaft 21 is rotated by some motor means, its rotary motion is tranmitted to the solid of rotation 31 and to bearing 42. Bearing 42 engages under the pressure of spring 41 the control plate or disk 43. Control plate or disk 43 is pivotable about a pair of pins 40, thus allowing to adjust the inclination of control plate or disk 43 in the same way as that of control plate or disk 36 may be adjusted. Consequently, an oscillatory motion is imparted to the solid of rotation 31 relative to shaft 21 in a direction longitudinally of shaft 21. To be able to perform this oscillatory motion, the solid of rotation 31 is mounted on a sleeve or slide bearing 49 formed by balls, and interposed between it and shaft 21.

As shown in FIG. 4, the inclination of the trajectories of rotary bearings 34 and 42 and of their support plates 36 and 43 is effected by a joint control means or adjustment means 44. This means includes the adjustment screw 45 whose axially inner end is conical. The conical end of adjustment screw 45 engages coaxial adjustment pins 46 and 47 which are moved in opposite directions by the conical end of screw 45. The axially outer ends of pins 46 and 47 effect a tilting of plates 36 and 43 about equal angles, but in opposite directions. It is also possible to tilt plates 36 and 43 about unequal angles. To this end screw 50 is provided which allows to vary the effective stroke of pin 46 relative to the effective stroke of pin 47.

As shown in FIG. 4 a helical compression spring 48 is interposed between plates or disks 36 and 43. The purpose of this spring 48 is to stabilize the positions of disks 36 and 43.

It will be apparent from the above, that in the device or machine according to the present invention the shaft 24 supporting tool 25 and the solid of rotation 31 always oscillate in opposite directions. Since the mass of the solid of rotation 31 is substantially equal to the mass of shaft 24 and the mass of tool 25, it is possible to largely avoid transmission of oscillatory motions from these parts of the machine to other parts thereof such as, for instance, head 22. To the extent that the masses of both oscillatory systems differ from each other, such as in case when tools having different masses are applied, this may be compensated—at least in part—by means of screw 50, subjecting plates 36 and 43 to different inclinations.

In FIG. 2 a large clearance has been shown between the recess in the solid of rotation and the pin of crank mechanism which enters into said recess. In a similar way a large clearance has been shown between pin 14 and recess 15. This has been done merely for purposes of greater clarity. Actually that clearance should be close to zero to establish positive drives between parts 1 and 12 and between parts 12 and 4.

The parts 5 and 16 in FIG. 2 have been referred-to as bearings because they receive in bearing-like fashion projections of the plate-shaped upper portion of shaft 4 or projections of the solid of rotation 12. The radially outer surface of bearings 5 and 16 may be roller-shaped to minimize friction with control plates 8 and 17.

The same has been stated above in regard to FIG. 2 as applies also to the parts 34 and 42 of FIG. 3.

The spring 18 of the structure of FIG. 2 and the spring 41 of FIG. 3 are the preferred embodiment of the invention. These springs may be replaced by other means performing their function, i.e. maintaining engagement under pressure between parts 5 and 8, and between parts 16 and 17, respectively.

I claim as my invention:

1. A polishing machine for performing polishing operations and similar operations involving rotary motions and simultaneous oscillatory motions by a shaft in a direction longitudinally thereof, said machine comprising (a) a rotatable driven shaft;

(b) a tool-supporting shaft arranged in coaxial relation to and spaced from said driven shaft;

(c) a solid of rotation surrounding said driven shaft;

(d) a first crank shaft mechanism driven by said driven shaft positively transmitting the rotary motions thereof to said solid of rotation;

(e) a first bearing projecting in cantilever fashion from said solid of rotation and rotating jointly with said solid of rotation;

(f) a first control plate being engaged under pressure by said first bearing and inclined in one direction to the common geometrical axis of said driven shaft and said tool-supporting shaft thereby imparting oscillatory motions to said solid of rotation in a direction longitudinally of said driven shaft;

(g) a first slide bearing in said solid of rotation for said driven shaft;

(h) means jointly rotatable with said tool-supporting shaft at the end thereof remote from its tool-supporting end;

(i) a second crank shaft mechanism driven by said solid of rotation positively transmitting the rotary motions thereof to said means jointly rotatable with said tool-supporting shaft;

(j) a second bearing projecting in cantilever fashion from said means jointly rotatable with said tool-supporting shaft and rotating jointly with said tool-supporting shaft;

(k) a second control plate being engaged under pressure by said second bearing and inclined in a direction opposite to said one direction to the common geometrical axis of said driven shaft and said tool-supporting shaft thereby imparting oscillatory motions to said tool-supporting shaft in a direction longitudinally thereof and of opposite phase than the oscillations of said solid of rotation; and (l) a second fixed slide bearing supporting said tool-supporting shaft.

2. A device as specified in claim 1 wherein a helical compression spring is interposed between said solid of revolution and said means jointly rotatable with said tool-supporting shaft to engage said first bearing under pressure with said first control-plate and to engage said second bearing under pressure with said second control-plate.

3. A device as specified in claim 1 wherein said first slide bearing and said second slide bearing are both ball bearings.

4. A device as specified in claim 1 wherein a helical compression spring is interposed between said first control-plate and said second control-plate exerting pressure in opposite directions upon said first-control plate and said second control-plate.

5. A device as specified in claim 1 including means for adjusting the inclination of said first control-plate and of said second control-plate relative to the geometrical axis of said driven shaft and of said tool-supporting shaft, said means including a pair of coaxial pins jointly movable in opposite directions and controlling the spacing between said first control-plate and said second control-plate at the point where said pair of pins is located.

6. A device as specified in claim 5 including a joint means for controlling said pair of pins, said joint means comprising a screw arranged at right angles to said pair of pins having a conical end in engagement with said pair of pins for driving said pair of pins in opposite directions axially outwardly in response to turning said screw.

7. A device as specified in claim 1 wherein the mass of said solid of rotation is substantially equal to the mass of said tool-supporting shaft plus the mass of parts oscillating jointly with said tool-supporting shaft.

* * * * *